US006504557B2

(12) United States Patent
Kosyachkov et al.

(10) Patent No.: US 6,504,557 B2
(45) Date of Patent: Jan. 7, 2003

(54) CHARGE EMITTING PRINT HEAD FOR IMAGE FORMING SYSTEMS

(75) Inventors: Alexander A. Kosyachkov, Mississauga (CA); Igor Kubelik, Mississauga (CA); Lech Jedral, Campbell, CA (US); Dung Nguen, Oakville (CA); Rossitza Ivanova, Toronto (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/867,864

(22) Filed: May 29, 2001

(65) Prior Publication Data

US 2002/0180858 A1 Dec. 5, 2002

(51) Int. Cl.[7] ..... B41J 2/41
(52) U.S. Cl. ..... 347/127

(58) Field of Search ..... 347/123, 127, 347/128, 151

(56) References Cited

U.S. PATENT DOCUMENTS 4,426,654 A * 1/1984 Tarumi et al. ..... 347/127
6,377,289 B1 * 4/2002 Philebrown et al. ..... 347/127

FOREIGN PATENT DOCUMENTS

JP 9-123516 A * 5/1997

* cited by examiner

*Primary Examiner*—Joan Pendegrass
(74) *Attorney, Agent, or Firm*—Fay, Sharpe, Fagan, Minnich & McKee, LLP

(57) ABSTRACT

A print head suitable for use in an image forming system is provided having a pair of electrode layers separated by an isolating structure that includes a semiconductor. The presence of the semiconductor, such as a semiconductor layer, extends the life of the print head by reducing degradation of the print head.

18 Claims, 4 Drawing Sheets

FIG. 1A (PRIOR ART)
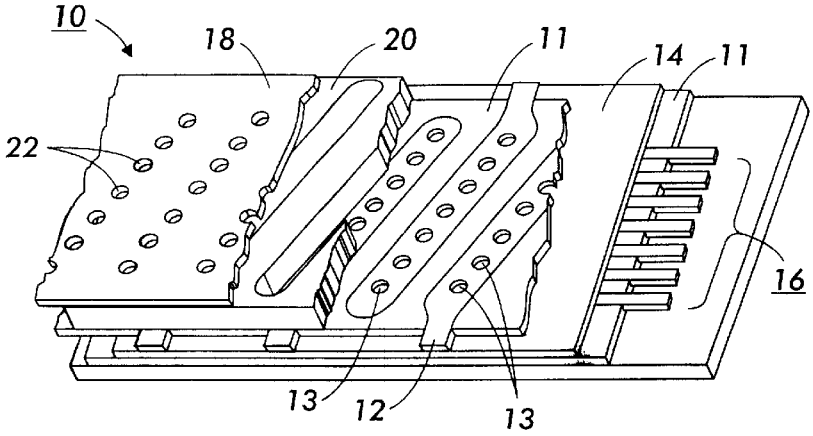
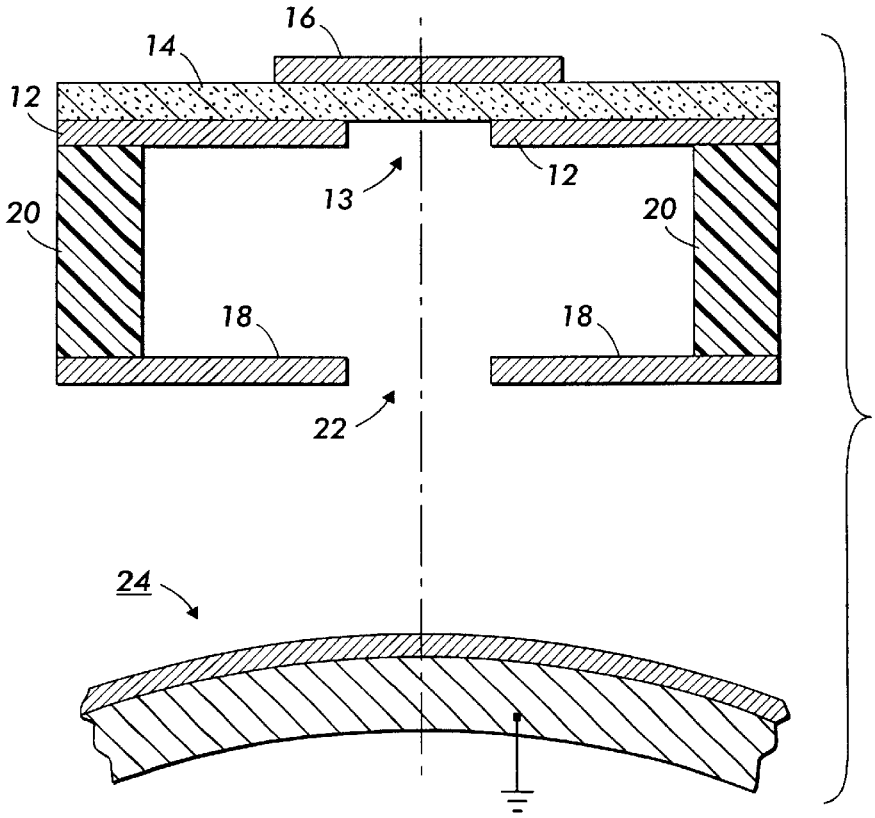
FIG. 1B (PRIOR ART)

CHARGE EMITTING PRINT HEAD FOR IMAGE FORMING SYSTEMS

TECHNICAL FIELD

The present invention relates generally to image forming systems, and specifically relates to charged particle emitting print heads utilized in electron beam imaging printing.

BACKGROUND OF THE INVENTION

In an image forming system, such as ionography, or electron beam imaging (EBI), a latent electrostatic image is formed on an imaging dielectric surface by directing beams of charged particles onto the surface. The latent electrostatic image thus formed may then be developed by applying toner particles to the imaging surface that are attracted to those areas of the imaging surface where the electrostatic latent image resides. The toner particles on the imaging surface are then transferred to a receiving member (such as paper) before the imaging surface is cleaned in preparation for a new imaging cycle.

The source of the beams of charged particles in the image forming system is a print head. Referring to FIG. 1A, a typical print head 10 includes three layers that have electrodes. A first layer includes a plurality of RF-line electrodes 16 separated from a second layer of finger electrodes 12 by a dielectric layer 14. A third layer is a screen electrode 18 isolated from the finger electrodes by a spacer layer 20. The surface of both the RF-line electrodes 16 and the finger electrodes 12 can be smoothed by a smoothing dielectric 11. In thin film structures, the smoothing dielectric is usually SOG (spin on glass). The finger electrodes 12 have finger openings 13, typically circular, which are generally aligned with the apertures 22 in the screen electrode 18, as shown in FIG. 1A. The RF line electrodes 16 intersect the finger electrodes 12 where the finger openings 13 are located. If a high voltage is applied to the finger electrodes 12 and the RF-line electrodes 16, an electrical breakdown of air inside the finger openings 13 occurs.

Referring to FIG. 1B, a cross-section of a single charge production site of the print head 10 is shown. The electrical breakdown causes formation of gaseous plasma full of charged ions and electrons. While the polarity of particles used for imaging is determined by the polarity of the screen electrode 18 potential with respect to a grounded imaging member 24, on/off switching of charge emission from the print head 10 is regulated by a potential difference between the screen electrode 18 and the finger electrodes 12.

The dielectric layer 14 is typically formed from stoichiometric compounds, such as silicon oxide, silicon nitride, silicon oxy-nitride, aluminum oxide, titanium oxide, boron nitride, etc., or their combination. Electrical conductivity of such materials is very low, about $10^{-14}$ S/cm or less at room temperature.

A disadvantage of conventional print heads, and especially print heads designed for high density printing, is that the dielectric layer is subject to degradation. In particular, with repeated printing cycles, the plasma generated in the finger openings 13 degrades the dielectric layer.

Referring to FIG. 2, evidence of the dielectric degradation is shown. Underneath the finger electrode with a circular opening, there can be seen a dielectric layer, which in this particular case is aluminum oxide. The dielectric layer has been subjected to electrical discharges for a time equivalent to printing about 150,000 pages. Significant erosion of the dielectric material can be seen in the amount of dielectric by-products formed in the area around the opening. Such deterioration leads to charge generation reduction and therefore to print quality degradation. Ultimately, such degradation can lead to a full dielectric breakdown of the print head.

SUMMARY OF THE INVENTION

For the aforementioned reasons, there exists in the art a need for an electron beam imaging print head less susceptible to degradation arising from plasma generation.

The present invention provides a print head for an image forming system that is resistant to erosion. The print head comprises RF-line and finger electrodes separated by an isolating structure containing a dielectric and a semiconductor or resistive material. For example, the isolating structure may include a dielectric coated with a layer of semiconducting material. Typically, the semiconductor utilized in the present invention has a conductivity between about $10^{-6}$ and about $10^{-3}$ S/cm. The semiconductor can be made of a solid solution of a gas in a metal or semiconductor, where the gas includes a hydrogen gas, a nitrogen gas, an oxygen gas, and a halogen gas, or their mixtures. The semiconductor may also include solid solutions of non-metals in a metal, where the nonmetals include boron and/or carbon.

BRIEF DESCRIPTION OF THE DRAWINGS

FIG. 1A shows a conventional charge emitting print head with three layers of electrodes separated by dielectric materials.

FIG. 1B is a schematic cross-section of a single charge emitting site of the print head illustrated in FIG. 1A.

DETAILED DESCRIPTION OF THE INVENTION

Figure 3:
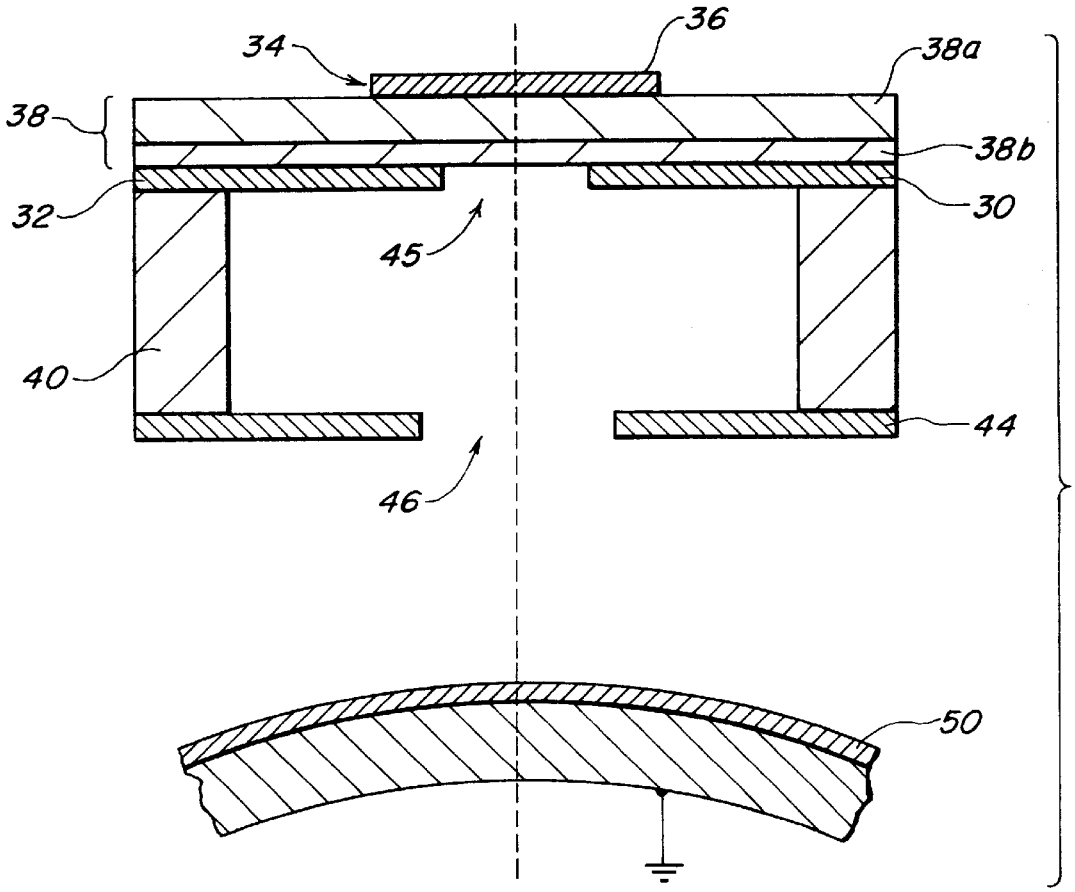
FIG. 3 shows a schematic cross-section of a single charge-emitting site of the present invention.

Referring to FIG. 3, there is shown a single charge-emitting site of a print head of the present invention. The print head comprises multiple electrode layers. The layers comprise a first electrode layer 34 that includes RF-line electrodes 36, and a second electrode layer 30 that includes finger electrodes 32 with openings 45. The first electrode layer 34 and the second electrode layer 30 are separated by an isolating structure 38 that is electrically insulating. The isolating structure 38 includes a dielectric and a semiconductor or a resistive material.

The isolating structure 38 can include a dielectric layer 38*a* having a conductivity lower than about $10^{-14}$ S/cm. The isolating structure further includes a semiconductor layer 38*b* having a thickness of about 2 micrometers, and an electrical conductivity of between about $10^{-6}$ and about $10^{-3}$ S/cm. Examples of semiconductors that may be used according to the teachings of the present invention include solid solutions of gases, such as hydrogen, nitrogen, oxygen, and halogens, and non-metals, such as carbon and boron, in metals and semiconductors. A distinguishing feature of the materials used in the present invention is a relatively low concentration of dissolved elements as compared with those for stoichiometric compounds.

The print head further includes a screen electrode 44 with apertures 46 separated from the second electrode layer 30 by a spacer layer 40. The charges emitted from the print head help form a latent image on an imaging member 50 utilized for forming images on a substrate, such as paper.

Figure 2:
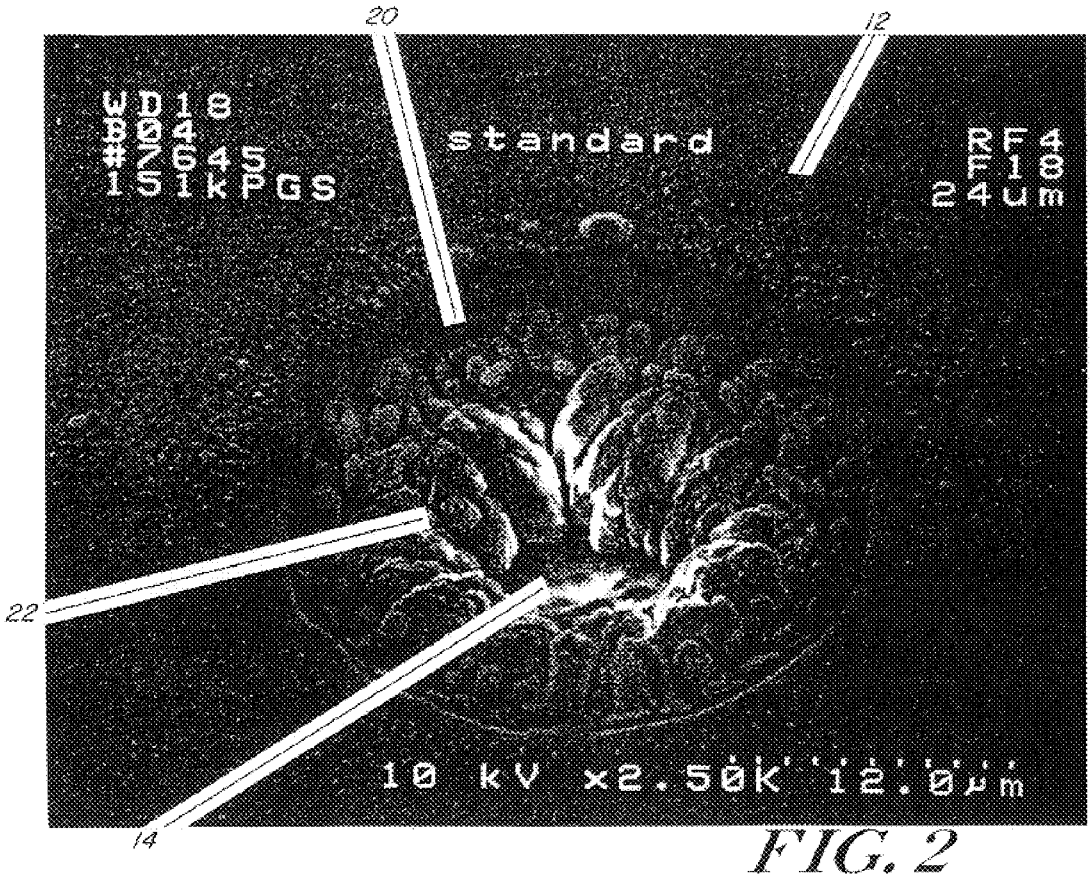
FIG. 2 illustrates the degradation of a dielectric separating finger electrodes from RF-electrodes.

The use of a semiconductor in the isolating structure 38 helps to decrease the degradation of the print head. In operation of the print head, a high frequency voltage is applied to the RF-line electrodes 36 resulting in plasma generation inside the finger openings 45. Without a semiconductor in the isolating structure 38, during a half- period of the applied voltage, particles of one polarity bombard the central part of the surface of the dielectric layer 38*a,* charging the surface to a voltage almost equal to the voltage of the finger electrodes 32. Around the charged area, a strong fringing electric field arises causing a local increase of the kinetic energy of opposite polarity particles bombarding the dielectric surface during the next half-period. Such a bombardment causes sputtering of the dielectric layer. Liberated atoms may chemically react with reactive ions and finally create by-products as shown in FIG. 2.

Including a semiconductor in the isolating structure 38, however, according to the teachings of the present invention, helps to reduce these by-products. For example, coating the dielectric layer 38*a* with the semiconductor layer 38*b* allows for charge migration inside the upper part of the isolating structure 38. As the surface of the dielectric layer 38*a* is negatively charged, some electrons migrate toward the surface of the dielectric layer 38*a,* as well as laterally. These partially mobile electrons effectively screen the electrical fringing fields and therefore reduce the energy of the impinging positive ions during the next half-period of the applied voltage. To prevent print head degradation, the electrical conductivity of the semiconductor in the isolating structure 38 may be judiciously chosen to accommodate the frequency of the applied voltage and the dimensions of the print head.

Figure 4:
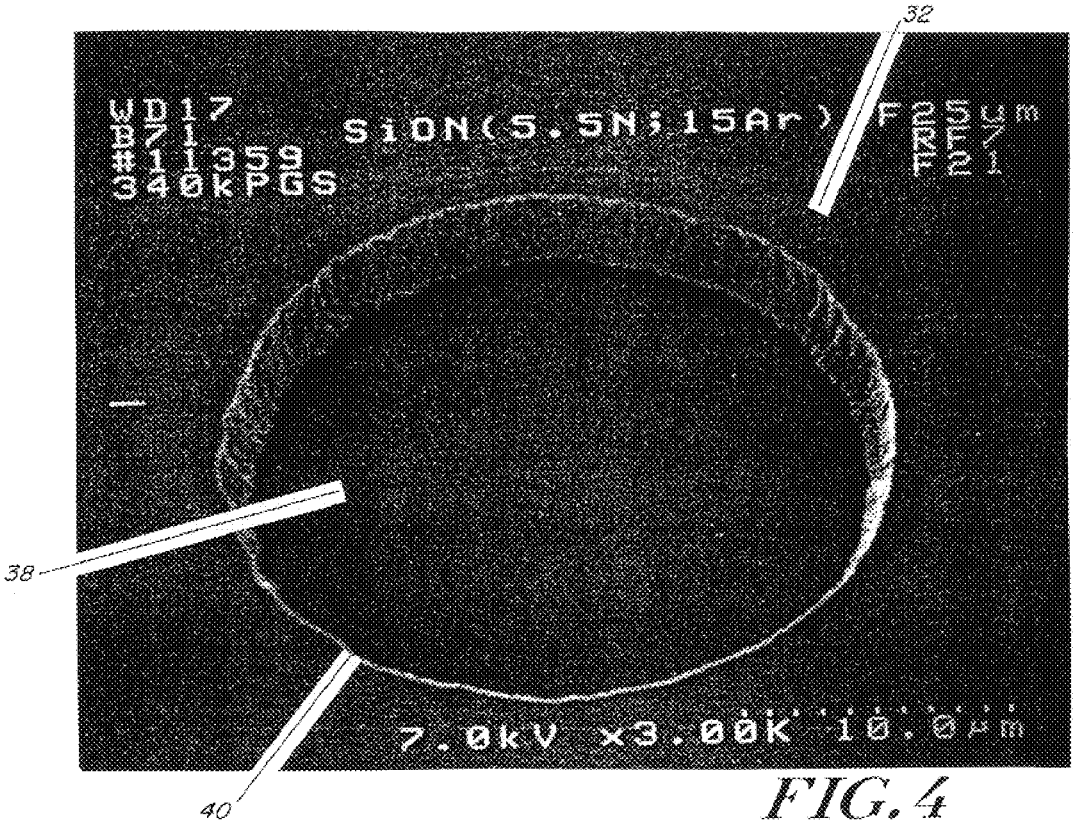
FIG. 4 illustrates the reduction of print head degradation as a result of applying the principles of the present invention.

FIG. 4 illustrates the significant reduction in degradation that occurs if a semiconductor layer 38*b* is used to cover the top side of the dielectric layer 38*a*. The opening 45 and surrounding structure shown in FIG. 4 has been subjected to electrical discharges and resulting air plasma for a time equivalent to printing about 340,000 pages. This time is more than twice the time that the dielectric surface of FIG. 2 has been exposed to electrical discharges. In contrast to the opening filled with by-products shown in FIG. 2, where the isolation structure is only a single dielectric layer 14, the opening 45 in FIG. 4 shows minimal degradation, and is almost free of by-products despite the longer exposure to air plasma. The reduction of the degradation in the print heads of the present invention, having an isolating structure 38 that includes a semiconductor, significantly extends the life of the print head.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

What is claimed:

1. A print head suitable for use in an image forming system, comprising a first electrode layer;

a second electrode layer; and an isolating structure disposed between the first electrode layer and the second electrode layer, said isolating structure including a semiconductor.

2. The print head of claim 1, wherein the isolating structure includes a dielectric layer and a semiconductor layer.

3. The print head of claim 1, wherein the semiconductor has a conductivity between about $10^{-6}$ and about $10^{-3}$ S/cm.

4. The print head of claim 1, wherein the semiconductor comprises a solid solution of a gas in a metal or a second semiconductor.

5. The print head of claim 4, wherein the gas comprises one of hydrogen, nitrogen, oxygen, and halogen.

6. The print head of claim 1, wherein the semiconductor comprises a solid solution of a non-metal in a metal.

7. The print head of claim 6, wherein the non-metal comprises one of boron and carbon.

8. The print head of claim 1, wherein the semiconductor comprises a solid solution of a non-metal in a second semiconductor.

9. The print head of claim 1, wherein the first electrode layer comprises at least one RF-line electrode and the second electrode layer comprises at least one finger electrode.

10. The print head of claim 1, wherein the second electrode layer has at least one opening filled with air, said at least one opening exposing an area of the isolating structure thereto.

11. The print head of claim 10, further comprising a screen electrode for charge separation, said screen electrode having at least one aperture.

12. The print head of claim 11, wherein the at least one aperture is aligned with the at least one opening.

13. A method of manufacturing a print head suitable for use in an image forming system comprising a) providing a first electrode layer;

b) providing a second electrode layer; and c) disposing an isolating structure between the first electrode layer and the second electrode layer, said isolating structure including a semiconductor.

14. The method of claim 13, wherein, in the step of disposing, the isolating structure includes a dielectric layer and a semiconductor layer.

15. The method of claim 13, wherein, in the step of disposing, the semiconductor has a conductivity between about $10^{-6}$ and about $10^{-3}$ S/cm.

16. The method of claim 13, wherein, in the step of disposing, the semiconductor is a solid solution of gasses in at least one of a metal and a semiconductor.

17. The method of claim 13, wherein, in the step of disposing, the semiconductor comprises non-metal elements.

18. A print head suitable for use in an image-forming system, the print head comprising:

a first electrode layer;

a second electrode layer; and, an isolating structure deposited between the first electrode layer and the second electrode layer, said isolating structure including a dielectric layer and a semiconductor layer.

* * * * *